United States Patent [19]

Pauletich

[11] 4,181,124

[45] Jan. 1, 1980

[54] THERAPEUTIC IMPLODER

[76] Inventor: Joseph Pauletich, 91-18 43rd Ave., Elmhurst, N.Y. 11373

[21] Appl. No.: 802,882

[22] Filed: Jun. 2, 1977

[51] Int. Cl.[2] ..... A61H 9/00; A63B 21/00

[52] U.S. Cl. ..... 128/66; 128/363

[58] Field of Search ..... 128/363, 364, 370, 66, 128/25 R, 25 B, 2 S; 272/72, 67, 68

[56] References Cited

U.S. PATENT DOCUMENTS

| | | | |
|---|---|---|---|
| 693,701 | 2/1902 | Gossman | 272/72 |
| 1,336,774 | 4/1920 | Cooper | 128/363 |
| 2,969,060 | 1/1961 | Swanda et al. | 128/25 R |
| 3,421,760 | 1/1969 | Freeman | 128/25 B |
| 3,585,991 | 6/1971 | Balamuth | 128/66 |
| 3,666,267 | 5/1972 | McKinney | 272/67 |
| 3,754,547 | 8/1973 | Walker | 128/25 R |
| 3,807,729 | 4/1974 | Sigma | 272/68 |
| 3,859,954 | 1/1975 | Pauletich | 116/22 A |
| 3,859,994 | 1/1975 | Simon | 128/66 |

FOREIGN PATENT DOCUMENTS

| | | | |
|---|---|---|---|
| 441935 | 6/1975 | U.S.S.R. | 128/66 |

*Primary Examiner*—Lawrence W. Trapp

[57] ABSTRACT

There is hereinafter disclosed an assembly which primarily consists of an imploder which is capable of generating waves in solids and liquids. In the present case the imploder is inserted into a water tank in which there is provision for a person or groups of persons to sit or float. The tank retains a body of water surrounding the person(s) and it is the purpose of the imploder to produce waves in the water which are calculated to improve the condition of the person who may be suffering from a paralysis due to polio, stroke and the like. In addition, the assembly consists of various exercise components particularly for the hands and feet of the paralyzed user.

3 Claims, 6 Drawing Figures

THERAPEUTIC IMPLODER

This invention relates to medical equipment and, in particular, to apparatus which provides exercise components for persons afflicted with a loss of function in one or more areas of the body.

The pool baths for various kinds of body exercise manipulations are well known in the art. The present invention affords an assembly of parts a tank of water and an imploder immersed therein which are combined to aid persons who are at least partially paralyzed in such areas of the body as the hands, arms and legs. The combination is expected to afford relief from discomfort as well as to improve functioning of such body members.

One object of the invention is to provide a new and improved assembly of components calculated to aid person afflicted with partial loss of body function.

Other objects and advantages of the invention may be appreciated on reading the following description of one embodiment thereof which is taken in conjunction with the accompanying drawings, in which.

Figure 1:
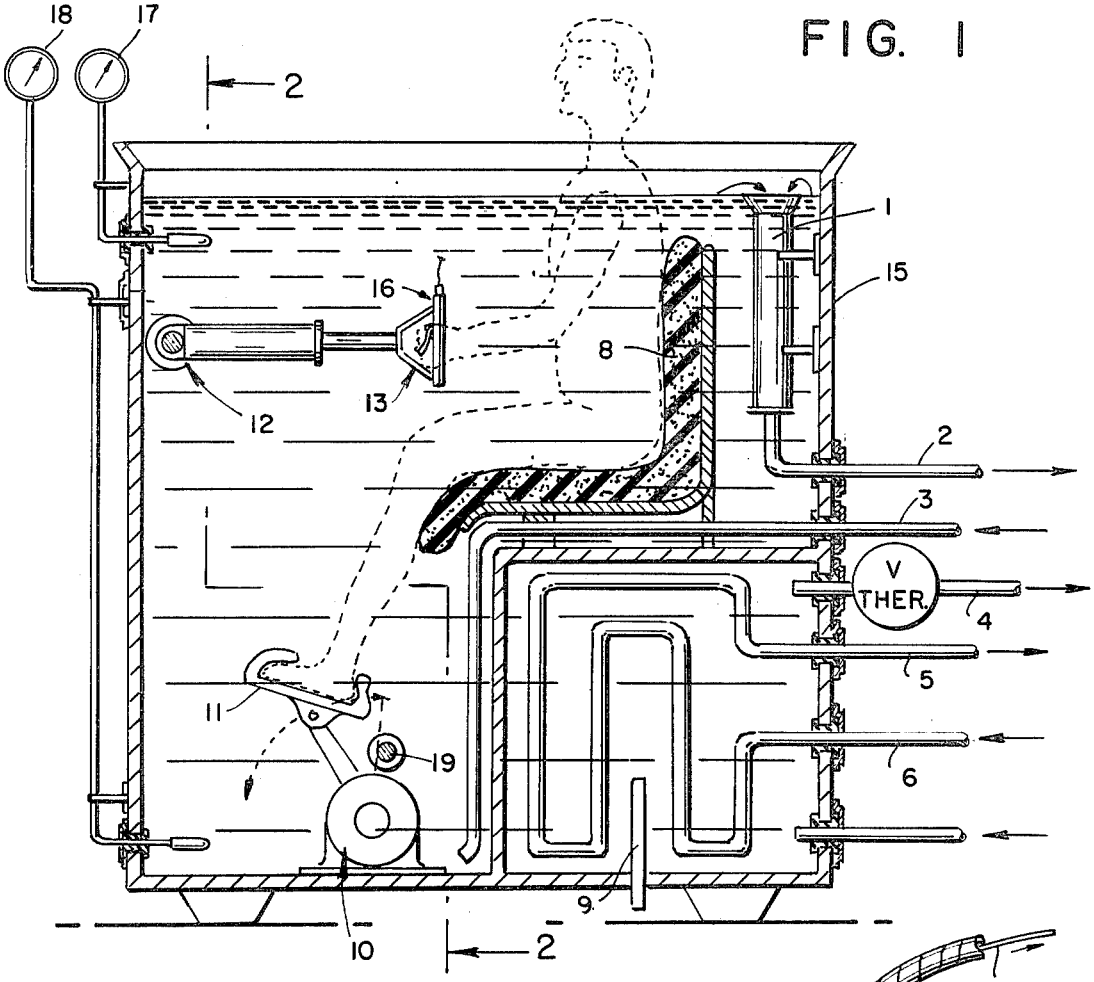
FIG. 1 is an elevation of the therapeutic imploder assembly.

Referring to the drawings metal tank 15 is filled nearly to the top as shown in FIG. 1. The water level is maintained by its level adjustment by means of drain 1 which communicates with tank water outlet 2. Water is supplied to the tank through inlet pipe 3, the tank having a water outlet 4 in which there is provided a thermostatic valve adjustable to 95 degrees or thereabouts. There is also provided a condensate outlet 5 and a steam inlet 6 for the for the imploder. An imploder which may be utilized for the purposes state herein is taught, for example, on U.S. Pat. No. 3,859,954. The person using the assembly sits on padded seat 8.

Figure 2:
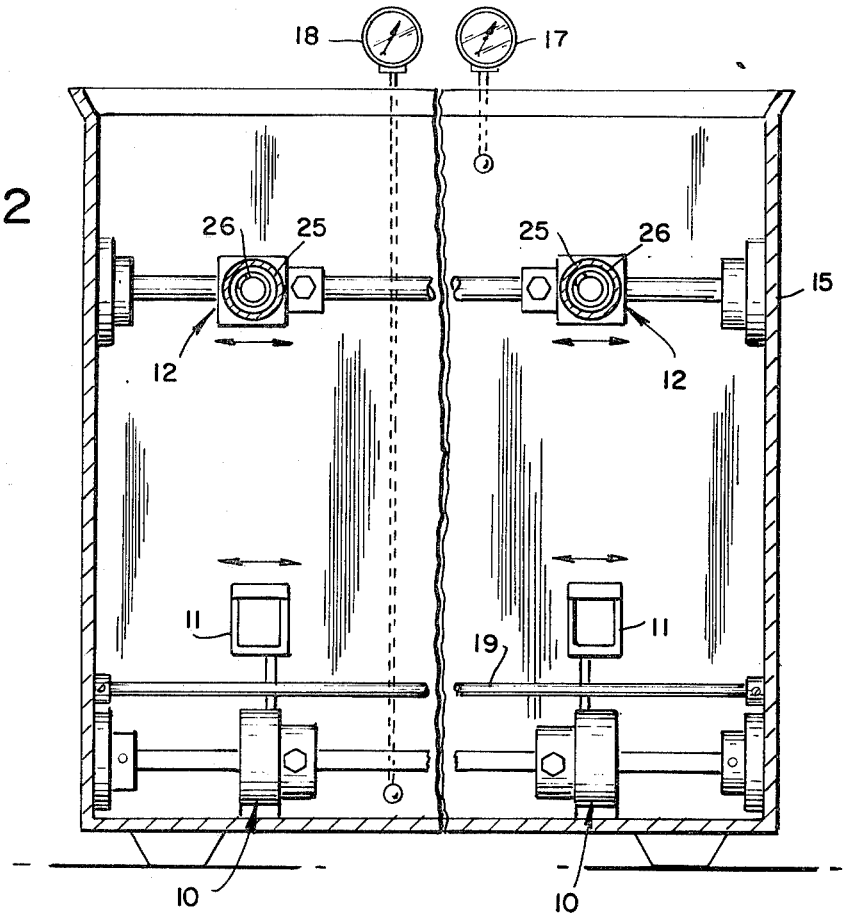
FIG. 2 is a section taken on the line 2—2 of FIG. 1.
Figure 4:
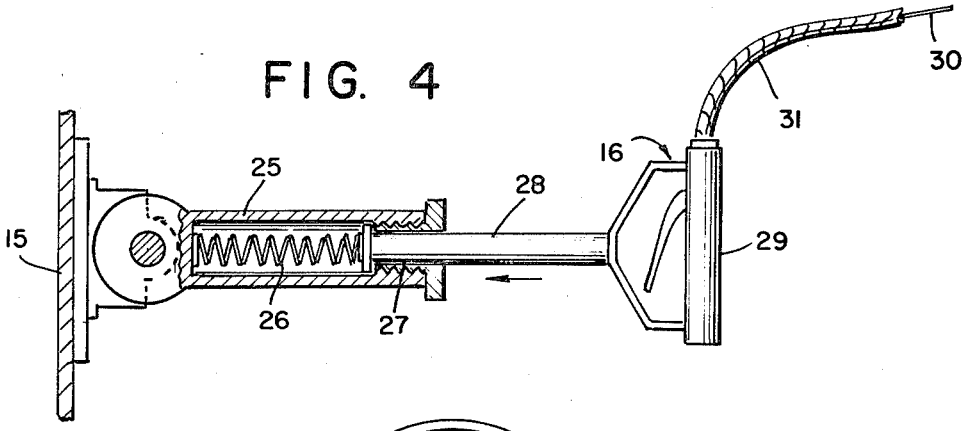
FIG. 4 illustrates the hand torque component of the assembly.

Spring-loaded swivel 10 is employed to exercise the feet and legs of the person using the tank who inserts his feet into pedal shoes 11, the swivel having a pedal stop 19. Hand torque assembly 12 and hand pusher 13 function to exercise the hands and arms employing straight line, twisting and finger squeezing movements. As shown in FIG. 2, both the hands and foot pedals are moveable laterally to adjust for the person(s) using the tank. The hand grip has a bicycle type brake grip 16.

The tank is provided with a pair of thermostats 17 and 18 at the top and bottom of the tank respectively whereby the water temperature in the two regions of the tank may be carefully monitored.

Figure 3:
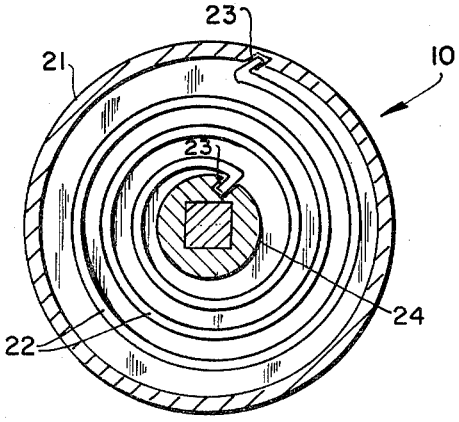
FIG. 3 is a detail showing the spring-loaded swivel designed to exercise the foot and leg of the user.

The spring-loaded swivel 10 is shown in detail in FIG. 3 and comprises an outer casing ring 21 in which there is inserted a coiled heavy steel tape 22 which is anchored at slot 23. The tape is wound and unwound by the human foot rear bushing 24 being instrumental to that end.

The hand torque assembly comprises an outer cylinder 25 containing spring 26. The person employing the assembly rotates threaded member 27 against the spring 26 by turning piston member 28 in a clockwise and counterclockwise manner.

Figure 5:
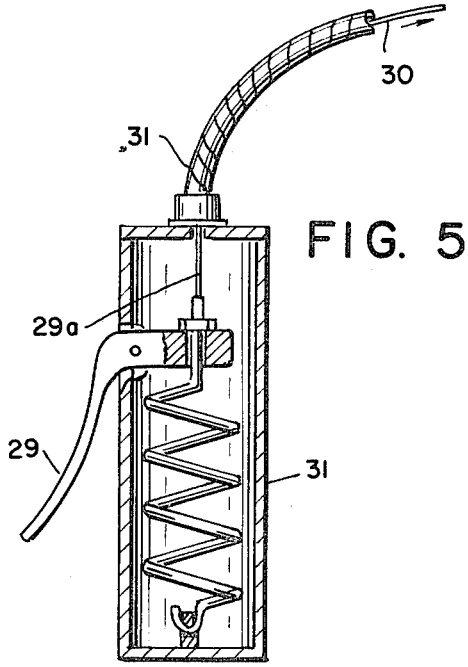
FIG. 5 illustrates the hand grip device which is one of the body member exercisers.
Figure 6:
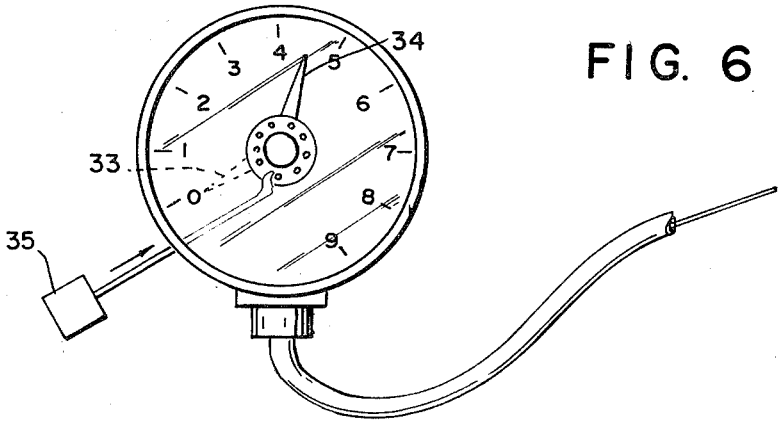
FIG. 6 illustrates the indicator which receives the output of the hand grip exerciser.

The hand grip device is shown in detail in FIG. 5 anc comprises a handle 29 which is pivotal to cause vertical movement of member **29*a* to actuate power cable 30 similar in operation to that of bicycle hand brakes. The device is provided with a housing 31 containing a spring located below the member 29*a*. Power cable 30 is connected to actuate a needle 33 in the indicator gauge shown in FIG. 6. The needle 33 is associated with a maximum trailer needle 34, the latter being settable to zero by member 35**.

Various embodiments of the invention may be effected by persons skilled in the art without departing from the scope and principle thereof as defined in the appended claims.

What is claimed is:

1. A therapeutic assembly comprising a tank, a wave generating imploder situated in said tank, a seat disposed in said tank, hand and feet exercise members located proximate said seat, said hand exercise member having means for affording torsional and straight line movement exercise for the user of said assembly.

2. A therapeutic assembly as defined in claim 1 wherein said hand exercise member includes means for affording a finger squeezing exercise for said user.

3. A therapeutic assembly comprising a tank, a wave generating imploder situated in said tank, a seat disposed in said tank, hand and feet exercise members located proximate said seat, wherein the hand exercise member includes a housing, a spring in said housing, an element adjustable vertically atop said spring within the housing, a power cable actuated by said element and a needle indicator connected to said power cable.

* * * * *